US007074026B2

(12) United States Patent
Graber, Jr.

(10) Patent No.: US 7,074,026 B2
(45) Date of Patent: Jul. 11, 2006

(54) MULTI-STAGE HELICAL SCREW ROTOR

(75) Inventor: John R. Graber, Jr., Murrysville, PA (US)

(73) Assignee: Leybold Vakuum GmbH, Cologne (DE)

( * ) Notice: Subject to any disclaimer, the term of this patent is extended or adjusted under 35 U.S.C. 154(b) by 154 days.

(21) Appl. No.: 10/021,974

(22) Filed: Oct. 30, 2001

(65) Prior Publication Data

US 2002/0048524 A1 Apr. 25, 2002

Related U.S. Application Data

(63) Continuation-in-part of application No. 09/691,009, filed on Oct. 18, 2000, now abandoned.

(51) Int. Cl.
*F03C 2/00* (2006.01)

(52) U.S. Cl. ..... 418/202; 418/201.1; 418/9; 418/3

(58) Field of Classification Search ..... 418/201.1, 418/202, 9, 3
See application file for complete search history.

(56) References Cited

U.S. PATENT DOCUMENTS

| | | | | |
|---|---|---|---|---|
| 1,738,602 | A * | 12/1929 | Mocigemba | 418/202 |
| 2,410,172 | A * | 10/1946 | Lysholm | 418/202 |
| 3,667,879 | A * | 6/1972 | Cerpelli | 418/202 |
| 4,504,201 | A * | 3/1985 | Wycliffe | 418/3 |
| 4,792,294 | A * | 12/1988 | Mowli | 418/201.1 |
| 5,348,453 | A | 9/1994 | Baran et al. | |
| 5,393,209 | A * | 2/1995 | Mohr et al. | 418/202 |
| 5,549,463 | A * | 8/1996 | Ozawa | 418/3 |
| 5,624,249 | A | 4/1997 | Rohlfing | |
| 5,674,063 | A | 10/1997 | Ozaki et al. | |
| 5,836,754 | A | 11/1998 | Ozaki et al. | |
| 5,846,066 | A * | 12/1998 | Troup | 418/3 |
| 6,129,533 | A | 10/2000 | Brandt et al. | |

FOREIGN PATENT DOCUMENTS

| | | |
|---|---|---|
| DE | 1142108 | 1/1963 |
| EP | 0697523 A2 | 2/1996 |
| EP | 0937895 A2 | 8/1999 |
| FR | 763458 | 5/1934 |
| GB | 242652 | 2/1926 |
| GB | 430601 | 6/1935 |
| GB | 552562 | 4/1943 |

(Continued)

OTHER PUBLICATIONS

Translation of Japanere Patent JP04-370379.*

*Primary Examiner*—Theresa Trieu
(74) *Attorney, Agent, or Firm*—Fay, Sharpe, Fagan, Minnich & McKee, LLP

(57) ABSTRACT

A vacuum pump includes an inlet port (14) and an exhaust port (86, 88). Gas from an enclosure connected to the inlet port is pumped to the exhaust port by first and second rotors (18, 52, 254) which are mounted on first and second shafts (30, 60) extending through a pump chamber (112). The rotors are connected with shaft sections (140, 150, 240, 250) which include a lobe (142, 172, 242, 242') extending from the shaft sections and a mating channel (152, 182, 252, 252') defined in the other. The lobes matingly engage the channels during rotation of the rotors to form a suction section (154). The suction section (154) compresses a volume of gas entering the pump from the inlet port (14) reducing the power consumed to move the volume of gas through the pump chamber more easily and increase pump efficiency.

49 Claims, 12 Drawing Sheets

FOREIGN PATENT DOCUMENTS

| | | | | |
|---|---|---|---|---|
| IT | 295288 | | | 4/1932 |
| JP | 57046083 | A | * | 3/1982 |
| JP | 60249689 | A | * | 12/1985 |
| JP | 02-108888 | | | 4/1990 |
| JP | 04370379 | A | * | 12/1992 |

* cited by examiner

MULTI-STAGE HELICAL SCREW ROTOR

This application is a continuation-in-part of U.S. application Ser. No. 09/691,009, filed Oct. 18, 2000, now abandoned.

BACKGROUND OF THE INVENTION

The present invention relates to the vacuum pump arts. It finds particular application in a helical screw rotor vacuum pump.

Screw vacuum pumps include two pairs of helical rotors attached to shafts which are driven at high speed by an electric motor positioned below the shafts. The rotors have a plurality of teeth on their edge or arrayed on one or both of their faces and, in use, the teeth rotate within a pumping chamber and urge molecules of gas being pumped through the pumping chamber.

A gearbox is usually positioned at the driven end of each shaft. The gearbox contains the shaft ends, bearings within which the shaft rotates, any timing gears and the motor positioned about the driven shaft.

Oils and/or greases associated with lubrication of the gearbox need to be contained and isolated within the gearbox. This is to ensure cleanliness and prevent non-contamination of the gases being pumped in the pumping chamber and to avoid the possibility of transfer of such contamination back into the enclosure being evacuated.

The conventional screw vacuum pump has working rooms for compressing fluid (gas) by decreasing its volume and working rooms which have no compression action on the fluid, but has merely a fluid feeding action. Therefore, in the conventional screw vacuum pump, the pressure rises up locally (at the portion which has the compression action), and this local rise-up of the pressure causes an abnormal temperature increase at parts of the rotors and the casing of the vacuum pump. That is, the temperature at the discharge side at which the working room reduces its volume and thus compresses the gas tends to abnormally rise up. As a result, the members constituting the screw vacuum pump are un-uniformly thermally expanded due to the local temperature increase, and thus the dimensional precision of the gap between the casing and the rotors and the engaging portion's gap between the male rotor and the female rotor cannot be set to a high value.

In some prior art screw vacuum pumps, pressure adjustment devices are provided on the lower surface of the casing and in the axial direction of the rotors in order to prevent excessive rise-up of the pressure of the working rooms and thus prevent the abnormal temperature rise-up of the vacuum pump when the vacuum pump works in a state where the suck-in pressure is substantially equal to the atmospheric pressure.

Minimizing power consumption in the pump is an ongoing challenge. Existing pump systems include suction sections at the ends of the rotors adjacent the closed end plates. The roots portions are provided at each of the both ends of the screw gear portions; that is, they are provided at both the suck-in side and the discharge port. A roots stage is needed adjacent the end plates. Including the suction sections at the ends of the rotor results in a less efficient compression and a smaller reduction in temperature. The roots portions of the existing pumps are difficult to machine and do not result in an appreciably larger volume of gas being trapped and accordingly result in less efficient compression.

Accordingly, it is considered desirable to develop an improvement to the power consumption of the pump condition which would reduce power needs at high pressures and reduce rotor sizes, which would overcome the foregoing difficulties and others while providing better and more advantageous overall results.

SUMMARY OF THE INVENTION

In accordance with a first aspect of the present invention, a vacuum pump includes a pump chamber in which an inlet and exhaust port are defined. First and second rotors are mounted parallel to each other in the pump chamber adjacent the inlet and outlet ports. A lobe is mounted to the first rotor adjacent the inlet port and a channel is defined in the second rotor adjacent the inlet port. The lobe and channel cooperate to form a suction section adjacent the inlet port.

In accordance with another aspect of the present invention, a method is provided for reducing the power consumed to move a volume of gas through a vacuum pump. A first shaft section is defined extending from a first rotor in a pump chamber adjacent an inlet port. A second shaft section is defined extending from a second rotor adjacent the inlet port. A lobe is provided on the first shaft section and a channel is defined in the second shaft section. The channel matingly engages the lobe to form a suction section between the rotors and the inlet port.

One advantage of the present invention is that it reduces power needs at high pressures, thus improving pump efficiency.

Another advantage of the present invention is that it reduces the temperature within the pump chamber due to lower power consumption.

Another advantage of the present invention is that it allows reduction in size of the rotors, thus reducing production costs.

Still another advantage of the present invention is that it reduces pump operating costs.

Yet still another advantage of the present invention is that providing the insert at the center of the screw rotors instead of at the ends of the rotors reduces machining costs.

Still other advantages and benefits of the invention will become apparent to those skilled in the art upon a reading and understanding of the following detailed description.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
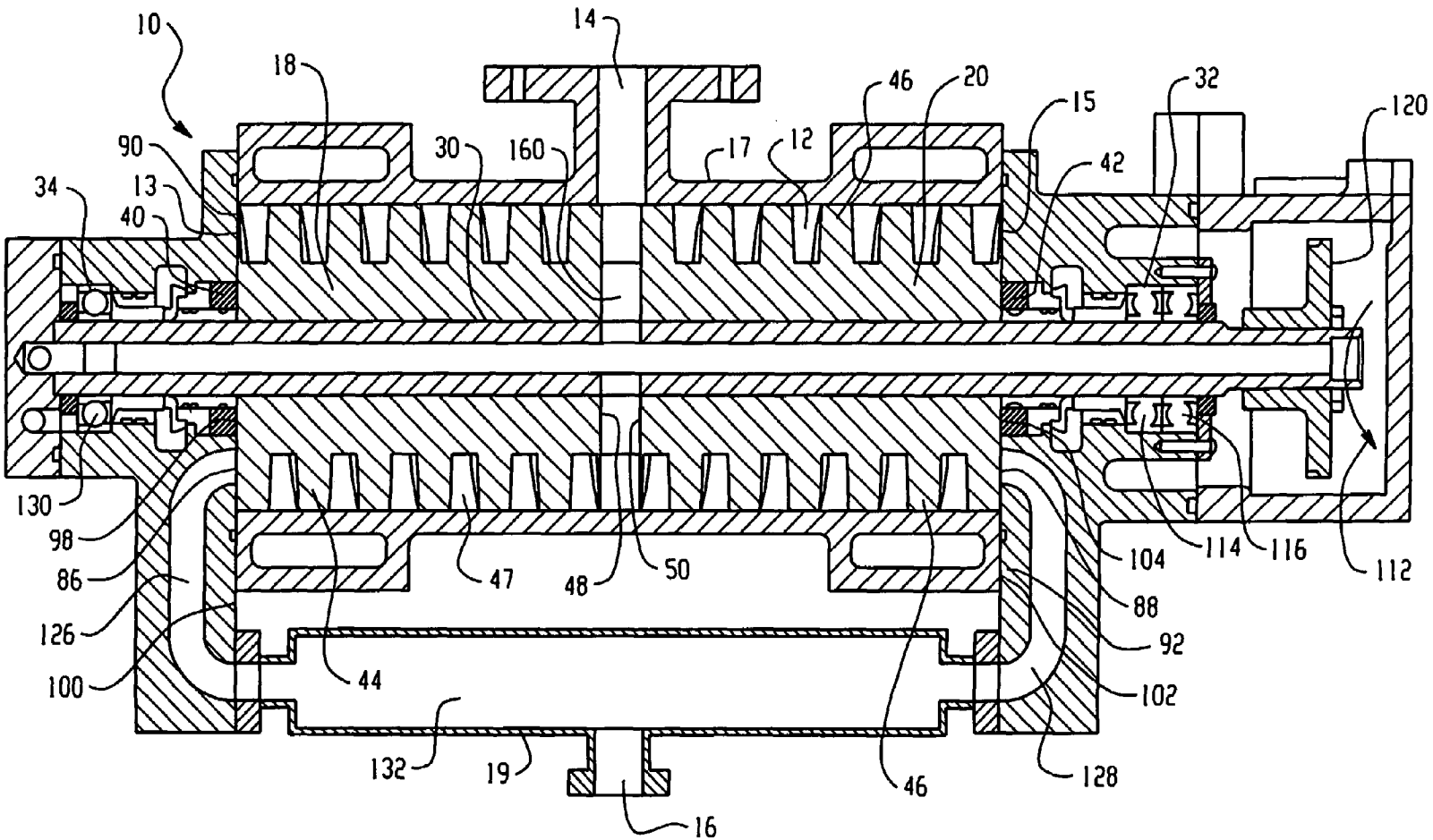
FIG. 1 shows a side elevational crosssectional view of the existing screw vacuum pump assembly.

With reference to FIG. 1, an existing screw vacuum pump comprises a vacuum pump 10 comprising a common pump chamber 12 having a first end 13, a second end 15, a third end 17, and a fourth end 19. The pump chamber 12 further comprises a central inlet port 14 located at the third end 17 of the chamber 12, through which gas from an enclosure (not shown) connectable to the inlet can be pumped to a pump high pressure exhaust port 16 located at the fourth end 19.

The chamber further includes a first pair of rotors 18, 20 located within the chamber adapted for high velocity rotation horizontally within the chamber. The first pair of rotors 18, 20 are mounted on a first shaft 30 extending through the chamber 12 and into bearing mounts 32, 34 located at opposite ends of the shaft 30. The bearing mounts 32, 34 are substantially isolated from the chamber by means of seals 42, 40, respectively, which are mounted on the shaft 30 and located on opposite ends of the shaft 30.

The rotors 18, 20 have teeth 44, 46, respectively, which when mated with a second set of rotors 52, 54 (shown in FIG. 2) create a plurality of closed chambers or cells 47 in the pump chamber 12 and urge molecules of gas to be pumped through the cells. The rotors each have low pressure inlet faces 48, 50 through which the inlet gas enters the rotor from the inlet port 14. The teeth 44 on the rotor 18 advance in an opposite direction from the teeth 46 on rotor 20 by virtue of opposite helix direction, thus moving the gas in an opposite direction.

Figure 2:
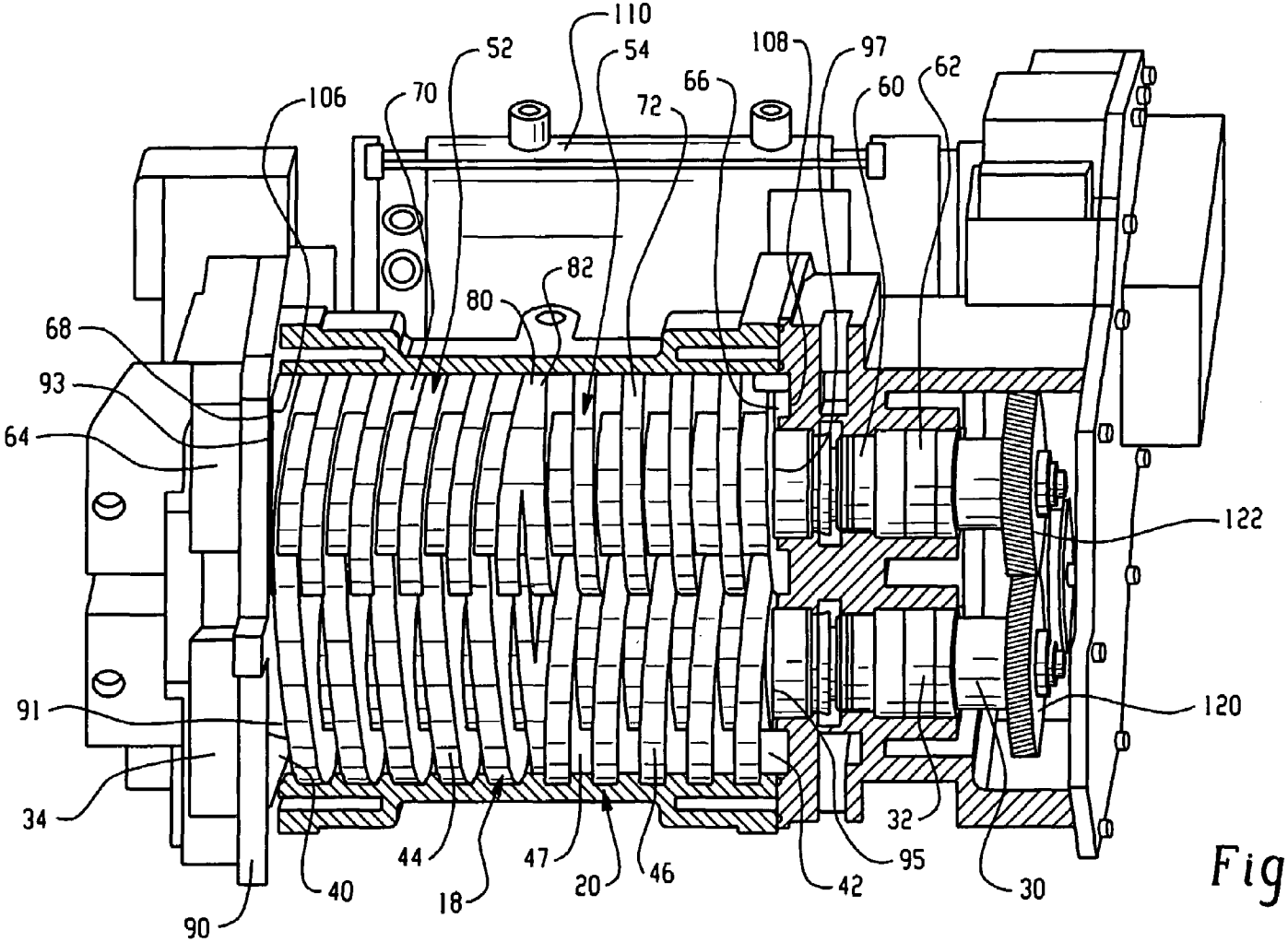
FIG. 2 shows a top elevational view of the existing screw vacuum pump.

Referring now to FIG. 2, the second pair of rotors 52, 54 are mounted on a second shaft 60, which is parallel to the first shaft 30. The second shaft 60 includes a bearing mount 62 and a seal 66 at one end of the shaft and a bearing mount 64 and a seal 68 at the opposite end of the shaft. The rotors 52, 54 have teeth 70, 72 which also advance in opposite directions from each other. The second set of rotors 52, 54 also have inlet faces 80, 82 through which gas enters the rotors from the inlet port 14.

The seals can be of a close tolerance but noncontact design. The seals 40, 68 are located adjacent an end plate 90 which is flush with ends 91, 93 of the rotor assemblies 18 and 52. The seals 42, 66 are located adjacent end plate 92 which is flush with the ends 95, 97 of the rotor assemblies 20 and 54.

Referring again to FIG. 1, gas enters the pump through the low pressure inlet port 14. The gas then moves in opposite directions along the helical rotors 18, 20, 52, 54 toward exhaust ports 86, 88 which are located at the first and second ends 13, 15 of the pump chamber 12 at end plates 90, 92, respectively. End plate 90 is located at end plane 100 and end plate 92 is located at end plane 102. The gas is essentially captured between the teeth of rotors 18, 20, 52, 54 and the fixed volume of gas is moved along the rotors 18, 20, 52, 54 toward the opposite end planes 100, 102. Rotors 18 and 52 move the gas toward end plane 100. Rotors 20 and 54 move the gas toward end plane 102. As the rotors are rotated on shafts 30, 60, the threads of the rotor threads move toward the end planes 100, 102. The seals each include a stationary side 98, 104, 106, 108, respectively, which are pressed into the end plates 90, 92.

Referring again to FIG. 2, the teeth 44 of the rotor 18 mesh with the teeth 70 of rotor 52 and push the fixed volume of gas toward the end plane 100. The teeth 46 of rotor 20 mesh with the teeth 72 of rotor 54 and push another fixed volume of gas in an opposite direction toward the end plane 102.

A motor 110 drives the shafts 30, 60. Referring to FIG. 2, the motor 110 is located beneath gearboxes 120, 122 at the motor drive end 112. The bearing mounts 32, 34, 62, 64 surround the shafts 30, 60 and house bearings within which the shafts 30, 60 rotate. Referring to FIG. 1, On the motor drive end 112 of the shafts, there is a pair of angular contact bearings 114, 116 which position the shafts radially and hold them in place axially in the pumping chamber. On the opposite side of the shaft is a single ball bearing 130 which also provides radial and axial support for the shafts.

As the gas enters the two exhaust ports 86, 88, it is transported to a first exhaust cavity 126 located at exhaust port 86 and to a second exhaust cavity 128 located at exhaust port 88. The first and second exhaust cavities lead to a third exhaust cavity 132 through which the gas flows into the high pressure exhaust port 16.

Figure 3:
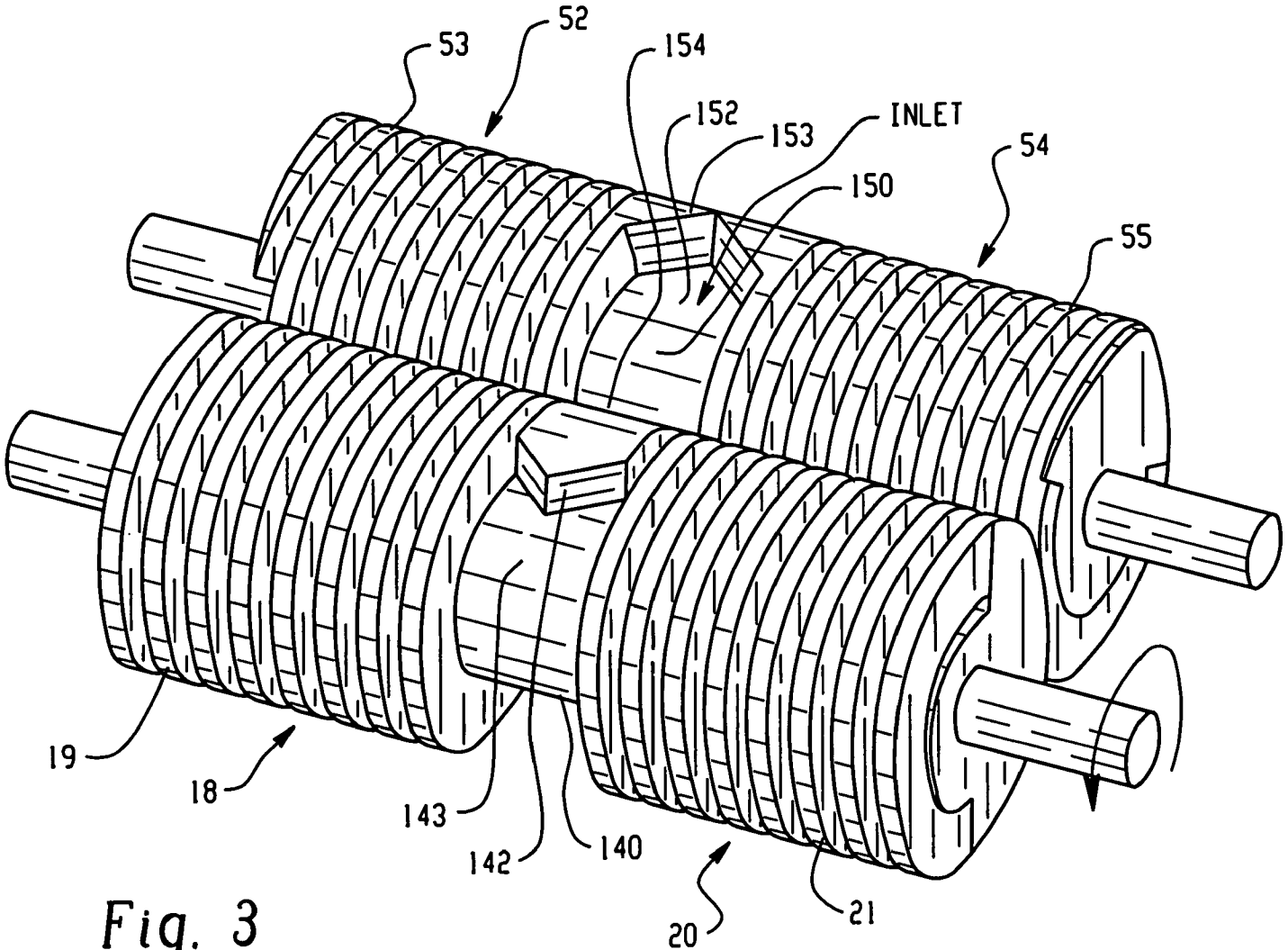
FIG. 3 shows a perspective view of a pair of rotors with the suction sections in accordance with the preferred embodiment of the present invention.

Referring to FIG. 3, rotors 18, 20, 52, 54 have screw thread sections 19, 21, 53, 55, respectively, which extend in opposite directions from the center of the rotors. At the center of the rotors 18, 20, 52, 54 are center shafts 140, 150 which are positioned below the inlet port 14 within the pump chamber. The shafts 140, 150 are positioned in the center gaps of the rotors. The center gaps have been increased in width to form the shafts 140, 150.

A preferred embodiment of the present invention comprises the shaft 140 having a raised relief male lobe or portion 142 and a female channel or portion 143 which is 180° opposite to the lobe 142 and is the negative profile of the lobe. Lobe 142 engages a correspondingly hollow female channel or portion 152 in the second shaft 150. Shaft 150 also has a male lobe or portion 153 which is 180° opposite channel 152 and is the negative profile of the channel. The male lobe 142 and the corresponding female portion or channel 152 are shown to be V-shaped in FIG. 3. The lobe 142 and channel 152 form a suction section 154. Channel 143 and lobe 153 also form a suction section opposite section 154.

Figure 4:
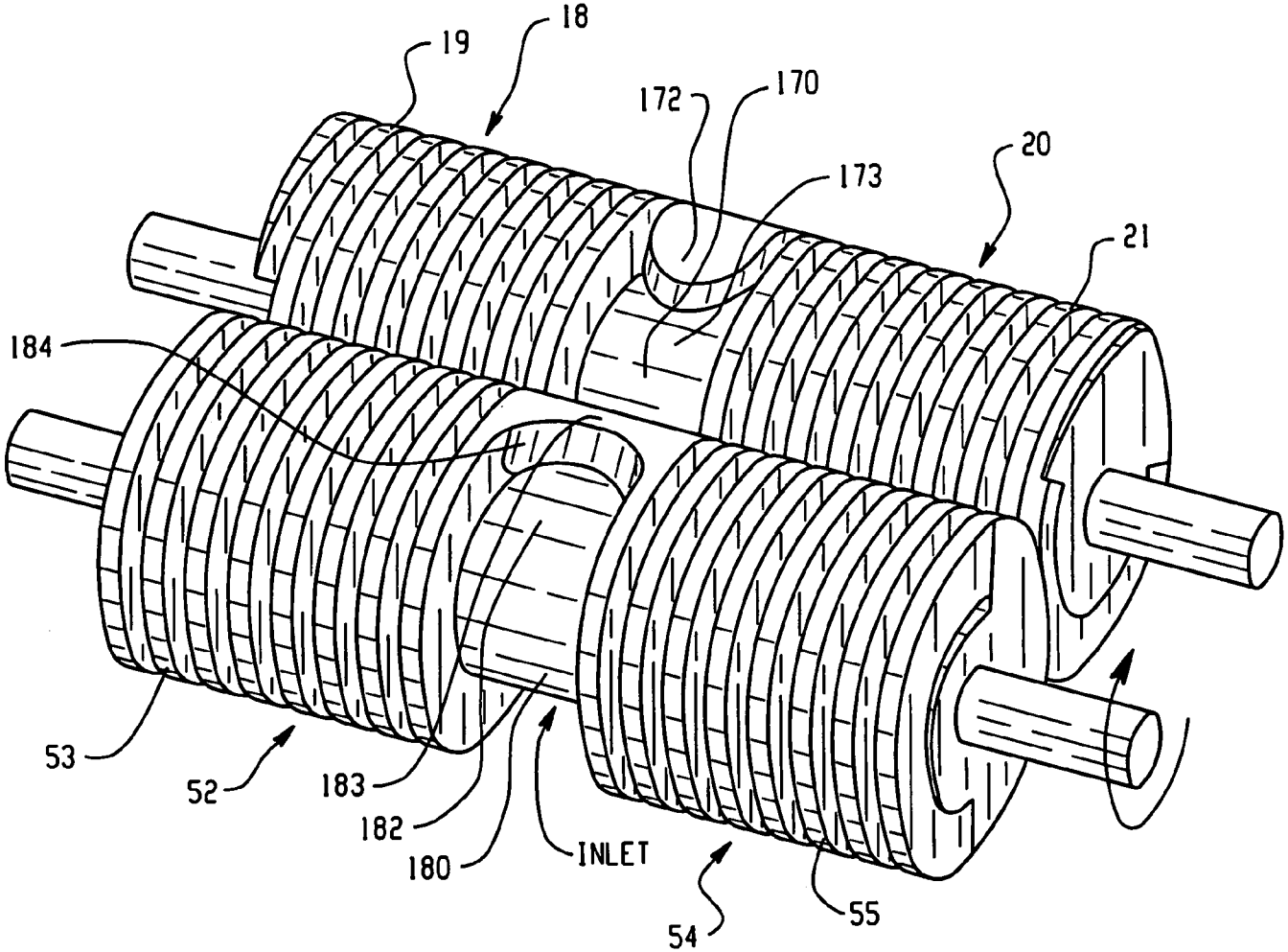
FIG. 4 shows a perspective view of a pair of rotors with the suction sections in accordance with a second preferred embodiment of the present invention.

However, in a second preferred embodiment, shafts 170 and 180 include a male lobe 172 and a female channel 182 which are round or radius-shaped as shown in FIG. 4. This radius (R) may be increased up to and including R is equal to infinity; in which case, the leading edge of the insert would be a straight line. This straight line may b parallel to the shaft centerline. The lobe 172 and channel 182 form a suction section 184. Similarly, shaft 170 also includes a channel 173 which is 180° opposite lobe 172 and shaft 180 includes a lobe 183 which is 180° opposite channel 182. There are other embodiments of the suction sections including multi-lobed suction sections which are not shown.

Figure 5A:
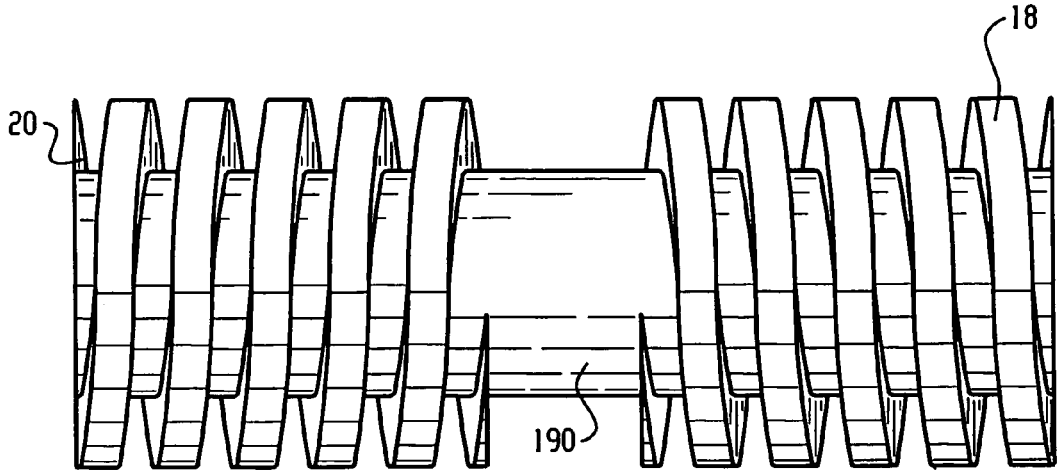
FIG. 5A shows an elevational view of a screw rotor with a widened center gap.
Figure 5B:
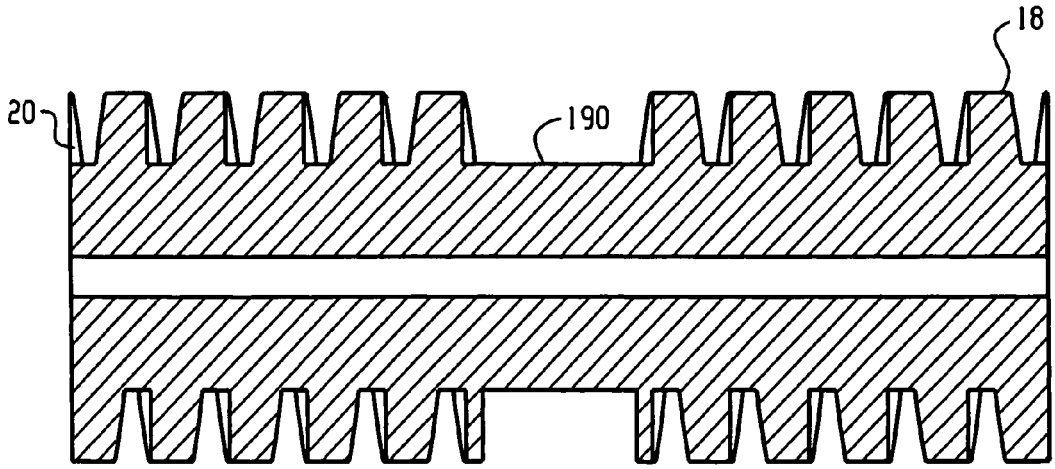
FIG. 5B shows a cross-sectional view of a rotor with a widened center gap.
Figure 6A:
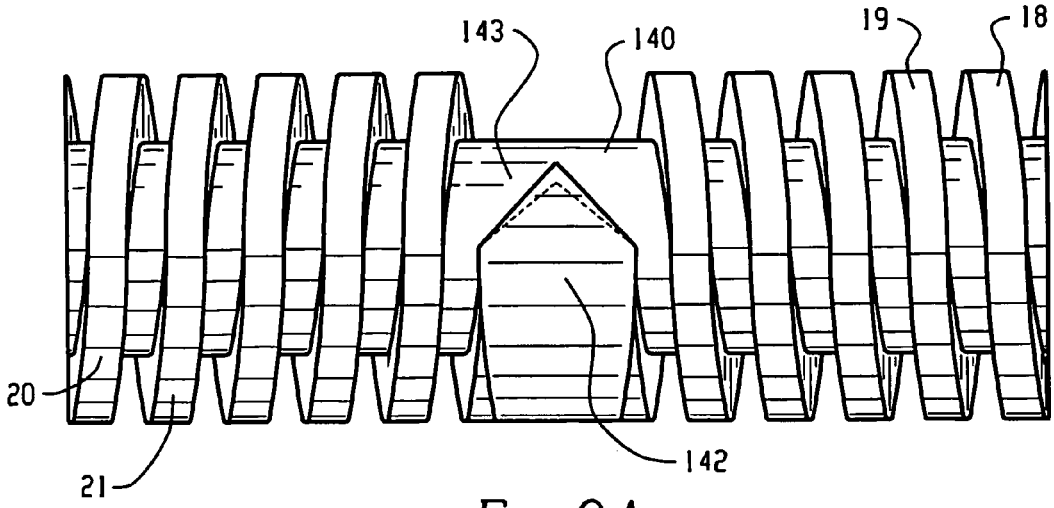
FIG. 6A shows an elevational view of a screw rotor with a V-shaped male lobe in the center gap.
Figure 6B:
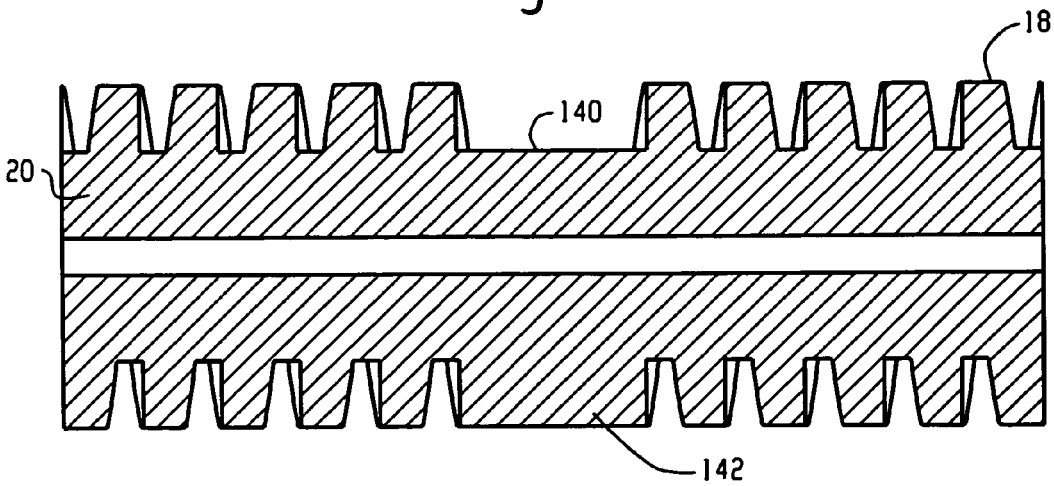
FIG. 6B shows a cross-sectional view of a screw rotor with a V-shaped male lobe in the center gap.
Figure 6C:
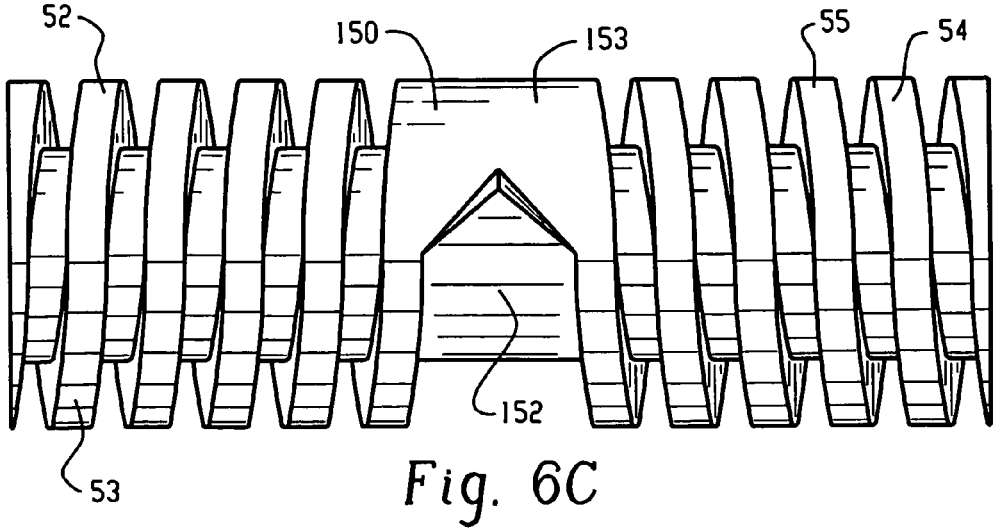
FIG. 6C shows an elevational view of a screw rotor with a V-shaped female portion in the center gap.
Figure 7A:
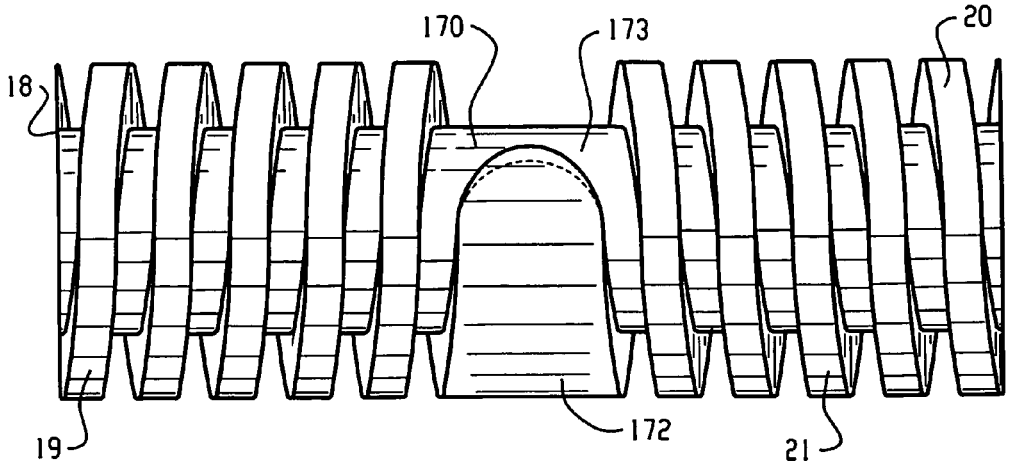
FIG. 7A shows an elevational view of a screw rotor with a radius-shaped male lobe in the center gap.
Figure 7B:
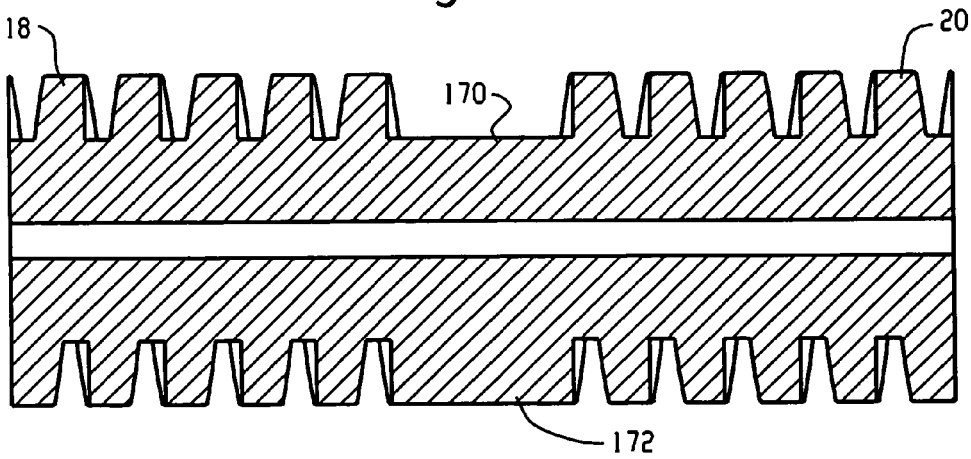
FIG. 7B shows a cross-sectional view of a screw rotor with a radius-shaped male lobe in the center gap.
Figure 7C:
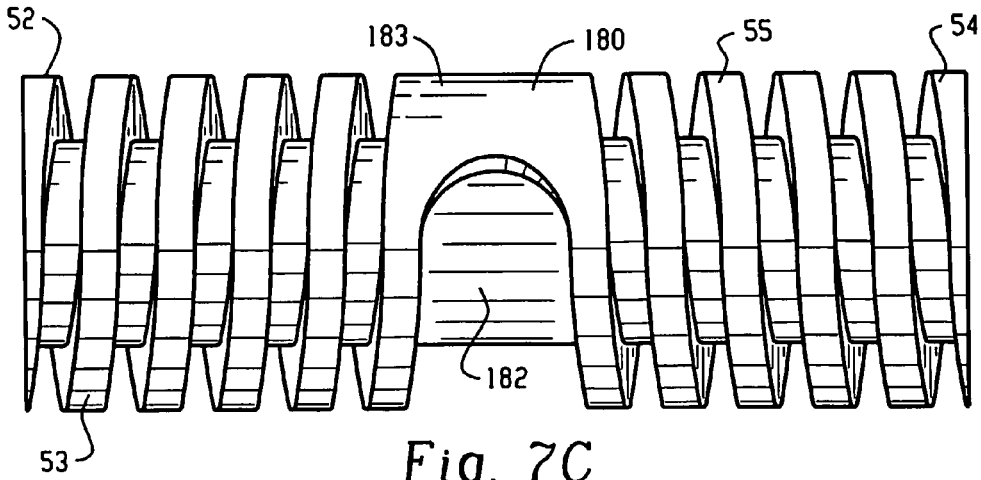
FIG. 7C shows an elevational view of a screw rotor with a radius-shaped female portion in the center gap.

As seen in FIG. 1, the existing pump screws have small center gaps 160. As seen in FIGS. 5A and 5B, the modification to the screw rotors includes increasing the width of the center gap shaft 190. As shown in FIGS. 6A, 6B, and 6C, a V-shaped insert is added to the center gap to forming male lobe 142 and correspondingly female channel 143 in shaft 140. FIG. 6C illustrates female channel 152 in shaft 150 and correspondingly male lobe 153. FIGS. 7A and 7B show a radius-shaped lobe 172 and female channel 173 in shaft 170. FIG. 7C shows a corresponding radius-shaped female channel 182 and lobe 183 in shaft 180.

FIG. 3 illustrates the interaction of the male lobe 142 and the female channel 152. Gas is sucked in through the inlet port 14 into the shaft sections 140, 150 and is compressed by the male lobe 142 and the female channel 152. At the initial stage, the suction section 154 increases in volume as the rotors rotate, drawing gas into the pumping chamber. At the point where shaft 150 reaches maximum volume, a position equivalent to that shown for shaft 140 in FIG. 3, the male lobe closes the suction section 154 to the inlet opening. With further rotation, the male lobe compresses the trapped suction gas into the adjacent screw section(s). The gas tightness of the suction section 154 is kept by the male lobe 142 and the female channel 152. The increase in compression of the gas resulting from the suction sections reduces the amount of power consumed to move a volume of gas through the pump.

Figure 10:
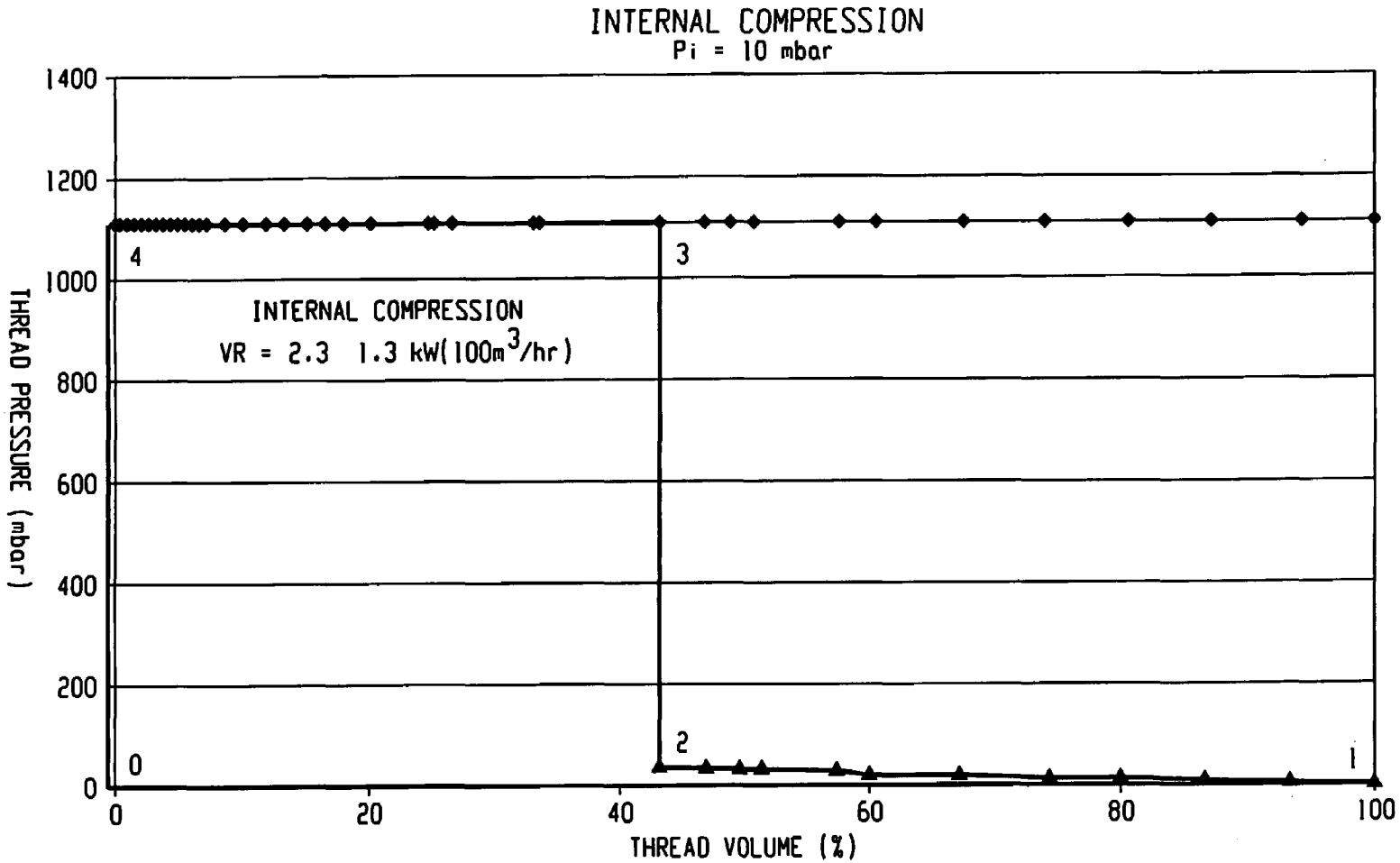
FIG. 10 is a graph of thread pressure vs. thread volume with internal compression at the center gap of the rotors.

Under normal vacuum operation, the power consumption is predominately determined by the rotor diameter and the screw pitch at the exhaust ends of the rotor. With the increased intake volume created by the suction section, the screws are supercharged, moving a considerably higher quantity of gas, determined by the selected volume ratio ($V_r$), with the same power consumption. The amount of power saved is illustrated in FIG. 10.

Figure 8:
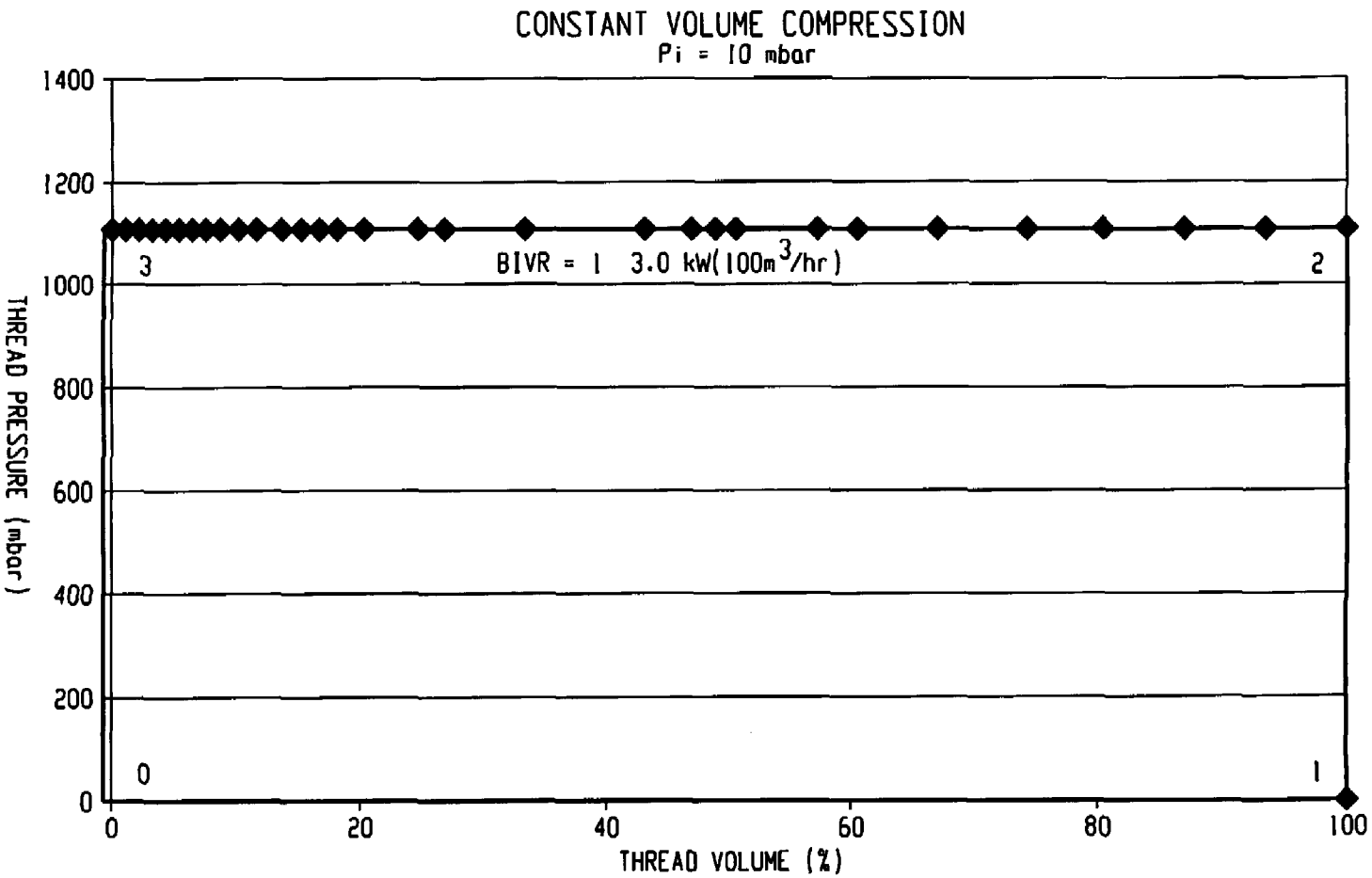
FIG. 8 is a graph of thread pressure vs. thread volume without internal compression.

FIG. 8 is a graph illustrating power needed to move a volume of 100 cubic meters of gas per hour through the screw rotor without any internal compression. That is, the area within the curve is theoretical power consumed (3kW of power) at an inlet pressure (Pi) of 10 mbar and an exhaust pressure of 1100 mbar. The built-in volume ratio $V_r$ is equal to 1 (one) since there is no internal compression. That is, the volume ratio is equal to the volume of gas trapped in the first screw thread at the inlet versus the volume of gas trapped in the last screw thread at the exhaust. Since there is no internal compression, the ratio is equal to 1. The cycle proceeds as follows. From state 0 to state 1, the volume of the thread is increasing with rotation of the rotor. At state 1, the first thread is closed to the inlet port. From state 1 to state 2, the closed thread advances from the inlet end to the exhaust end with the corresponding increase in pressure and without any reduction in volume. At state 2, the thread is opened to the exhaust plane. From state 2 to state 3, the transported gas is expelled from the pump. This amount of power is roughly equivalent to that which would be consumed by a roots blower or by a screw pump to move a volume of gas without internal compression (i.e., without any end plates).

Figure 9:
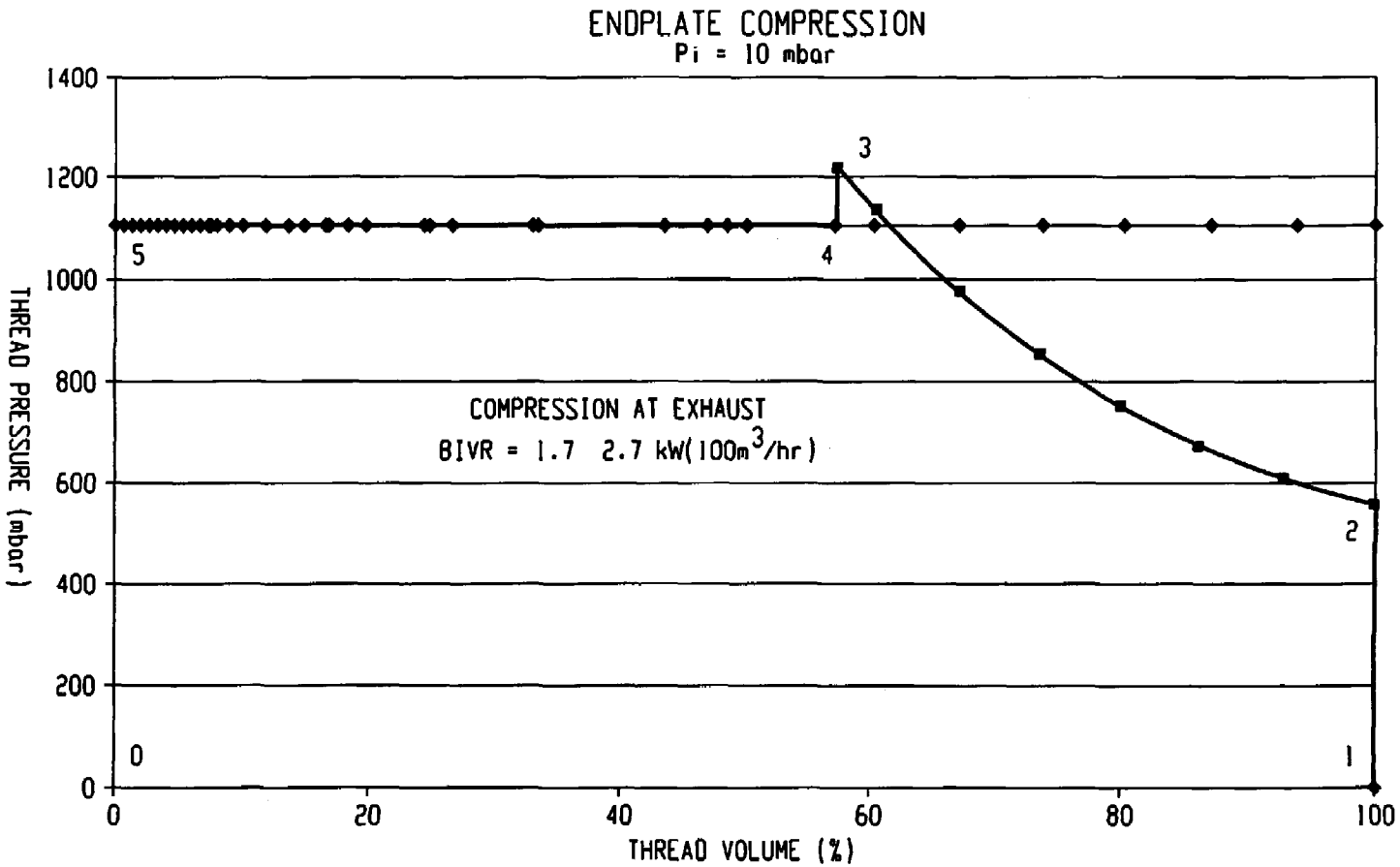
FIG. 9 is a graph of thread pressure vs. thread volume with internal compression at the ends of the rotors.

Referring now to FIG. 9, the graph illustrates that a power savings is obtained when internal compression is added to the pump at the exhaust ends of the pump cavity. The gas begins entering the pump chamber at state 0. This continues until maximum volume is achieved at state 1. From state 1 to state 2, the gas is transported from the inlet end to the exhaust end without any reduction in volume. At state 2, the thread is not immediately exposed to the exhaust by virtue of a close clearance end plate with a timed exhaust opening. From state 2, the thread arriving at the end plane is compressed against the end plate until the time when it is exposed to the exhaust opening at state 3. Depending on the thread pressure realized at state 2, and the selected $V_r$, there may be an over compression or under compression at state 3 (a slight over compression is shown). Upon exposure to the exhaust port, the thread pressure instantaneously achieves exhaust pressure (state 4). From state 4 to state 5, the gas is expelled from the pump.

The compression power needed to move a 100 cubic meter volume of gas per hour is 2.7 kW which is an approximately 10 percent savings in power from when there is no internal compression (3 kW of power). The built-in volume ratio ($V_r$) is 1.7. That is, the ratio of volume trapped in the first screw thread is 1.7 times the volume of gas trapped at the last screw thread at the exhaust.

In FIG. 10, the graph illustrates the power savings due to internal compression which occurs in the preferred embodiment of the present invention. In the present invention, the internal compression occurs at the center gaps below the inlet port as the gas is pumped into the opposite screw sections. This results in an over 50 percent reduction in power consumed as compared to the power and when there is no internal compression. That is, the power consumed to move 100 cubic meters of gas per hour through the pump chamber to the exhaust is 1.3 kW as compared to 3 kW without internal compression. The built-in volume ratio $V_r$ is 2.3. That is, the ratio of volume trapped in the suction section 154 is 2.3 times the volume trapped at the last screw thread at the exhaust.

Figure 11:
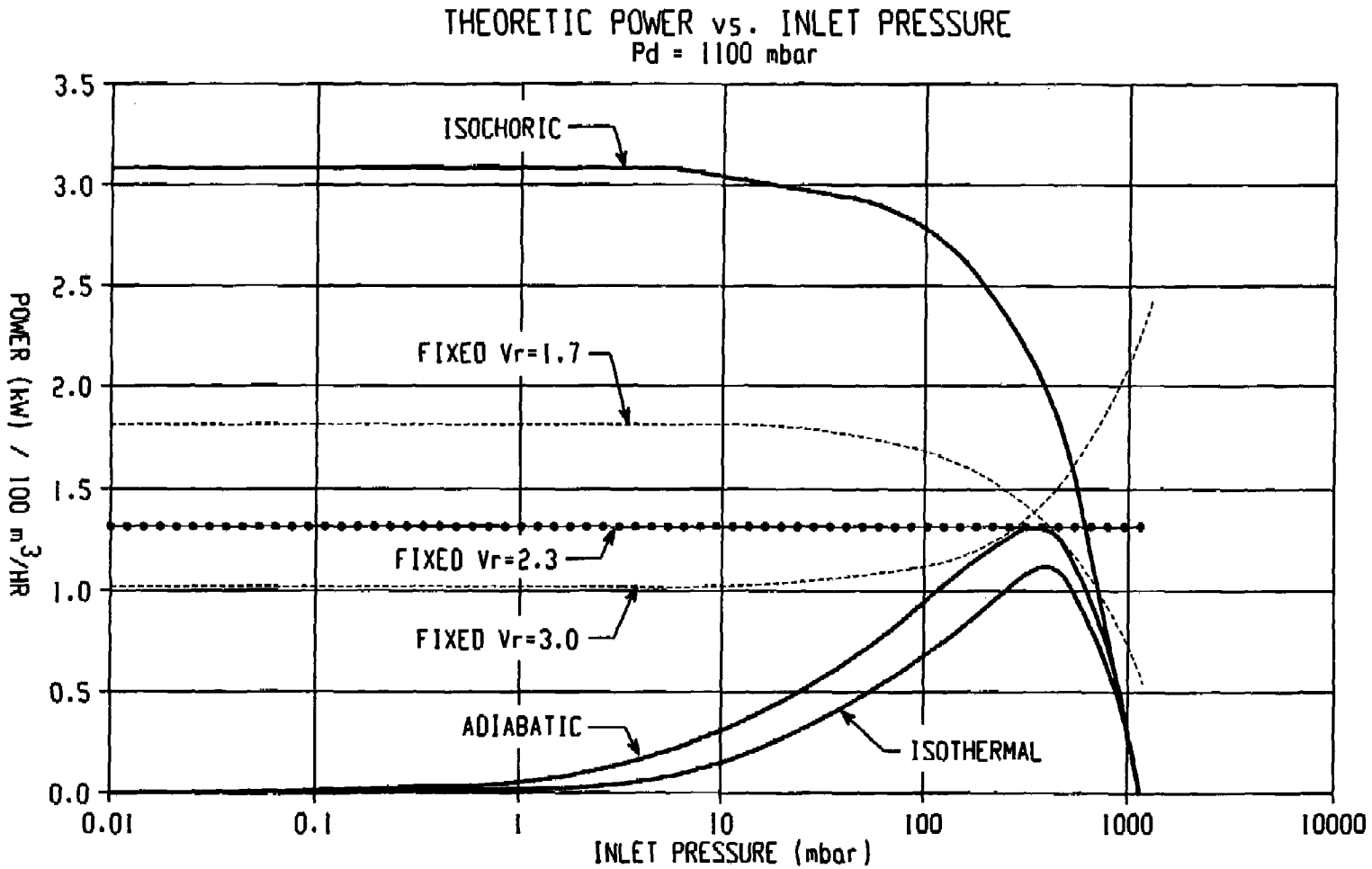
FIG. 11 is a graph of theoretic power vs. inlet pressure.

FIG. 11 illustrates various types of theoretical power versus inlet pressure. Isochoric pressure is shown which is pressure with constant volume pumping. Adiabatic pressure is shown which is pressure without heat exchange with the surroundings. The isothermal curve reflects power consumed when there is no change in temperature.

A fixed $V_r$ of 3 allows more power to be saved at low inlet pressure. That is, the higher the volume ratio, the more power is saved. Thus, at a $V_r$ of 2.3 (corresponding to FIG. 10) where internal pressure occurs at the center gap, additional power is saved than where internal compression occurs at the end of the rotors ($V_r$=1.7, FIG. 9). By varying the width of the center gap, the volume ratio can be altered thus changing the power consumption.

As the volume is compressed, the temperature within the pump chamber increases. When the volume is compressed at the end of the rotors, the temperature rises at the ends of the rotors. Since the volume is gradually compressed, the heat within the screw is distributed over the length of the screw. With the preferred embodiment of the present invention, since less power is needed to move the volume of gas, there is less temperature increase in the pump chamber.

Figure 12:
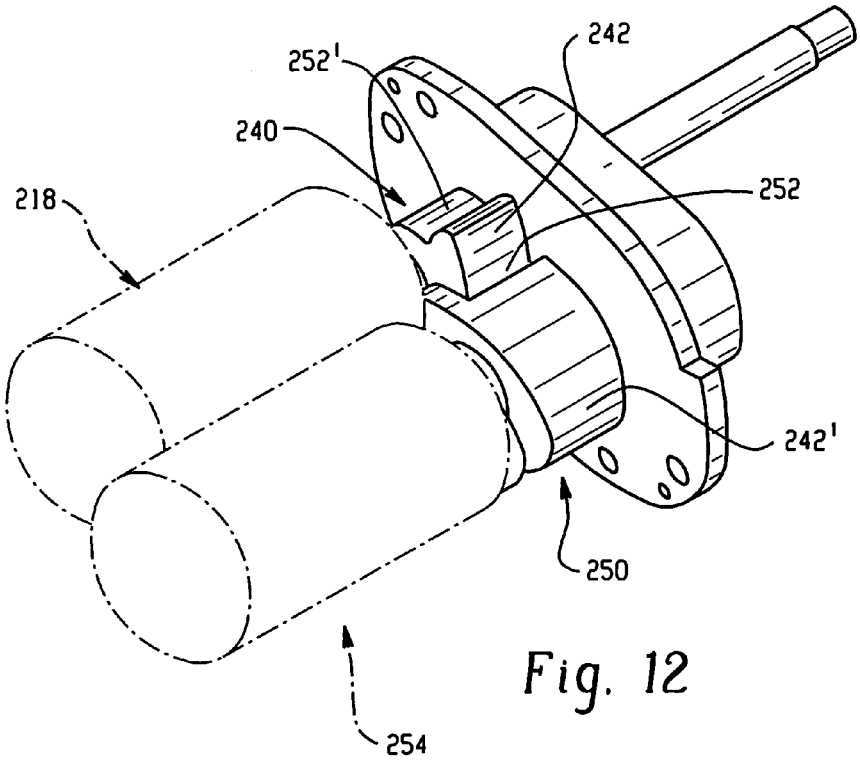
FIG. 12 is a perspective view of a pair of rotors with suction sections in accordance with another embodiment of the present invention.
Figure 13:
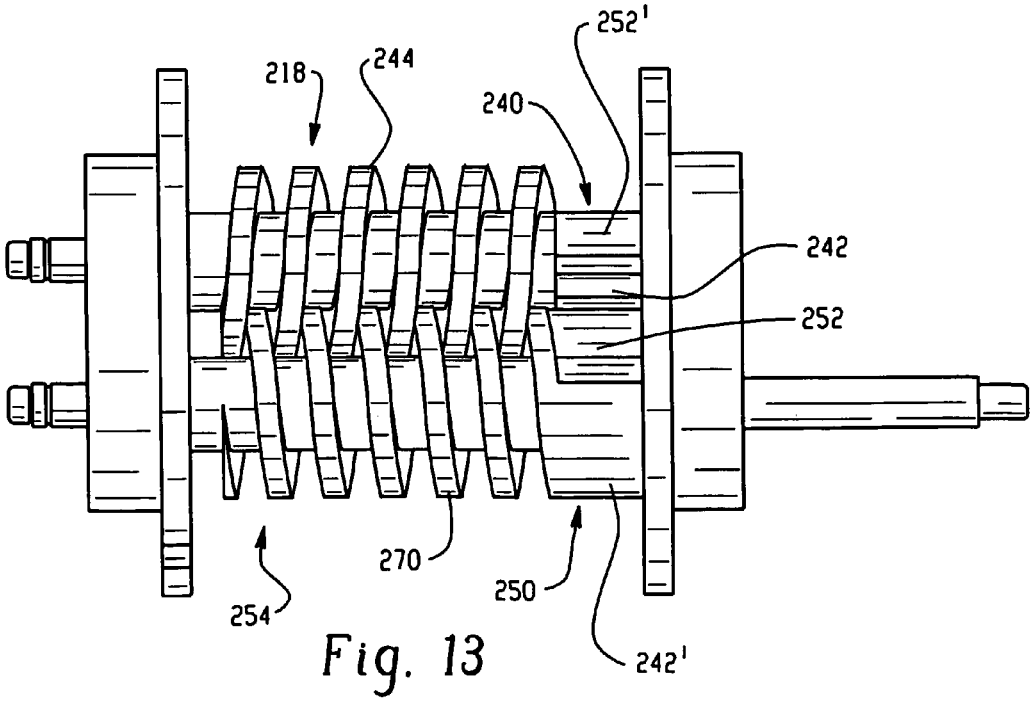
FIG. 13 is a top view of the rotors of FIG. 12.

With reference to FIGS. 12 and 13, a first rotor 218 includes a series of helical threads or teeth 244. A first shaft section 240 extends from an end of the helical threads adjacent an inlet port. A second rotor 254 defines a second set of helical threads or teeth 270 which mesh with the helical threads 244 of the first rotor. As the first and second rotors rotate, the helical threads pump gases from an inlet port, along their length, to an exhaust port adjacent an opposite end thereof. The second rotor 254 has a second shaft portion 250 extending from an inlet port end thereof. The first shaft portion 240 carries a lobe 242 which is received in a complementary channel 252. The second shaft section 250, 180° displaced from the first lobe and channel arrangement, defines a lobe 242' and the first shaft portion 240 defines a channel 252'.

There are various ways the power consumption can be altered by the suction sections. The width of the center gap can be altered. Secondly, the shape of the male and female lobe connections can be varied by different geometric configurations. Third, a multi-lobed configuration could be used in lieu of a single-lobed configuration.

The invention has been described with reference to the preferred embodiments. Obviously, modifications and alterations will occur to others upon a reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A vacuum pump comprising:

an inlet port and first and second exhaust ports through which gas from an enclosure connectable to the inlet port can be pumped to said exhaust ports;

a first end, a second end, a third end, and a fourth end of a pump chamber, said first exhaust port is located adjacent said first end, said second exhaust port is located adjacent said second end, said inlet port is located adjacent said third end;

a first and second pair of rotors, said first pair of rotors being mounted on a first shaft extending between said first end and said second end of said pump chamber, said first pair of rotors being spaced apart by a first center shaft between said rotors, said second pair of rotors being mounted on a second shaft extending between said first end and said second end of said chamber, said second pair of rotors being spaced apart by a second center shaft between said rotors;

said rotors each comprise a set of screw threads; and said first center shaft comprises a first lobe extending from said shaft and a first channel, and said second center shaft comprises a second lobe extending from said shaft and a second channel, wherein said first lobe matingly engages said second channel and said second lobe engages said first channel during rotation of said rotors.

2. The vacuum pump according to claim 1 wherein said second shaft is parallel to said first shaft.

3. The vacuum pump according to claim 1 wherein said first and second pairs of rotors each include teeth which mesh together and move a fixed volume of gas from said inlet port to said first and second exhaust ports.

4. The vacuum pump according to claim 1 further comprising a third exhaust port located at said fourth end of said pump chamber, and first, second and third exhaust cavities, wherein said first and second exhaust ports are connected via said first and second exhaust cavities to said third exhaust cavity, said third exhaust cavity is connected to said third exhaust port.

5. The vacuum pump according to claim 1, wherein said lobes are V-shaped.

6. The vacuum pump according to claim 5, wherein said channels are V-shaped.

7. The vacuum pump according to claim 1, wherein said lobes are radius-shaped.

8. The vacuum pump according to claim 7, wherein said channels are radius shaped.

9. The vacuum pump according to claim 1, wherein said first lobe and said first center shaft are of one piece.

10. The vacuum pump according to claim 1, wherein said first lobe comprises an insert secured to said first center shaft.

11. The vacuum pump according to claim 1, wherein said first lobe and said second channel form a first suction section which compresses a volume of gas entering said pump from said inlet port.

12. The vacuum pump according to claim 11, wherein said first suction section reduces the power consumed to move the volume of gas through the pump chamber and increases pump efficiency.

13. The vacuum pump according to claim 1, wherein said second lobe and said second center shaft are of one piece.

14. The vacuum pump according to claim 1, wherein said second lobe comprises an insert secured to said second center shaft.

15. The vacuum pump according to claim 1, wherein said second lobe and said first channel form a second suction section which compresses a volume of gas entering said pump from said inlet port.

16. The vacuum pump according to claim 15, wherein said second suction section reduces the power consumed to move the volume of gas through the pump chamber and increases pump efficiency.

17. A vacuum pump assembly comprising:

a first end and a second end;

an inlet port at a third end and at least one exhaust port at a fourth end;

a first shaft and second shaft parallel to each other extending between said first end and said second end, each shaft comprises a first end and a second end;

a first pair and second pair of rotors, said first pair of rotors being mounted about a diameter of said first shaft, said second pair of rotors being mounted about a diameter of said second shaft;

said first pair of rotors being spaced by a first center shaft and said second pair of rotors being spaced by a second center shaft;

said first center shaft comprises a lobe, and said second center shaft comprises a channel, wherein said lobe and said channel form a suction section.

18. The vacuum pump according to claim 17, wherein said lobe and said channel matingly engage during rotation of said rotors.

19. The vacuum pump according to claim 17, wherein said first and second pairs of rotors each comprise a set of screw threads.

20. The vacuum pump according to claim 17 wherein said first and second pairs of rotors each include teeth which mesh together and move a fixed volume of gas from said inlet port to said first and second exhaust ports.

21. The vacuum pump according to claim 17, wherein said lobe is V-shaped.

22. The vacuum pump according to claim 21, wherein said channel is V-shaped.

23. The vacuum pump according to claim 17, wherein said lobe is radius-shaped.

24. The vacuum pump according to claim 23, wherein said channel is radius shaped.

25. The vacuum pump according to claim 17, wherein said lobe and said first center shaft are of one piece.

26. The vacuum pump according to claim 17, wherein said lobe comprises an insert secured to said first center shaft.

27. The vacuum pump according to claim 17, wherein said suction section reduces the power consumed to move the volume of gas through the pump chamber and increases pump efficiency.

28. A vacuum pump comprising:

a pump chamber defining an inlet port and an exhaust port;

a first rotor having a first helical thread and a first helical cell extending from adjacent the inlet port to adjacent the exhaust port;

a second rotor having a second helical thread and a second helical cell extending from adjacent the inlet port to adjacent the exhaust port, the first and second helical threads and helical cells interengaging;

a lobe mounted to the first rotor adjacent an inlet port end of the first helical thread and the first helical cell and a channel defined in the second rotor adjacent the inlet port end of the second helical thread and the second helical cell, said lobe and said channel cooperating to form a suction section adjacent the inlet port which is intermittently closed from the inlet port, the lobe and the channel being different from the first and second helical threads, the lobe, the channel, and the first and second helical threads and helical cells being disposed within a common chamber, such that when the inlet port closes, during rotation of the rotors, suction gas is trapped in the suction section between the lobe and channel and a directly connected portion of at least one of the first and second helical helical cells and with continued rotation the suction gas trapped in the suction section is directly compressed into the at least one helical helical cell and is transported to the exhaust port.

29. The vacuum pump according to claim 28, wherein said lobe and said channel matingly engage during rotation of said rotors.

30. The vacuum pump according to claim 28, wherein said lobe is V-shaped.

31. The vacuum pump according to claim 30, wherein said channel is V-shaped.

32. The vacuum pump according to claim 28, wherein said lobe is radius-shaped.

33. The vacuum pump according to claim 32, wherein said channel is radius shaped.

34. The vacuum pump according to claim 28, wherein said suction section reduces the power consumed to move the volume of gas through the pump chamber and increases pump efficiency.

35. A vacuum pump for pumping a gas comprising:

a pump chamber defining an inlet port and an exhaust port;

a first rotor and a second rotor, the first and second rotors being mounted in the pump chamber adjacent the inlet and exhaust ports, the first and second rotors carrying first and second intermeshing screw threads that define a screw section in the pump chamber adjacent the exit port;

a lobe mounted to the first rotor adjacent in the pump chamber the inlet port and a channel defined in and extending less than fully circumferentially around the second rotor in the pump chamber adjacent the inlet port, said lobe and said channel cooperating to form a suction section adjacent the inlet port which compresses said gas, the suction section being in direct communication with the screw section.

36. A vacuum pump comprising:

a common pump chamber defining an inlet port and an exhaust port;

a first central shaft and a second central shaft mounted in the common pump chamber and extending between the inlet and exhaust ports;

a first non-helical lobe and a first channel disposed on the first central shaft adjacent the inlet port and a second non-helical lobe and a second channel disposed on the second central shaft adjacent the inlet port, said lobes and said channels being disposed in the common pump chamber and the first lobe and second channel and the first channel and second lobe cooperating to form a positive displacement suction section in the common pump chamber adjacent the inlet port;

a first rotor disposed on the first shaft in the common pumping chamber and extending from the lobe to the exit port;

a second rotor disposed around the central shaft and extending in the common pump chamber from the channel to the exit port, the first and second rotors defining a pumping section in direct communication with the positive displacement suction section.

37. The vacuum pump according to claim 36, wherein said first and second rotors each include a set of screw threads.

38. A vacuum pump comprising:

a pump chamber defining an inlet port and an exhaust port;

a first rotor and a second rotor, the first and second rotors being mounted in the pump chamber between the inlet and exhaust ports and defining a pumping section which extends to the exit port;

a first male portion mounted to the second rotor adjacent the inlet port and a first female portion defined in the first rotor adjacent the inlet port, said first male portion and said first female portion cooperating to form a first positive displacement suction section within the pump chamber adjacent the inlet port and connected to the pumping section; and a second male portion mounted to the first rotor adjacent the inlet port which second male portion cooperates with a second female portion defined in the second rotor to define a second positive displacement suction section in the pump chamber adjacent the inlet port and in connection with the pumping section.

39. The vacuum pump according to claim 38, wherein said first and second rotors each include teeth which mesh together to define the pumping section which moves fixed volumes of gas from said positive displacement suction sections to the exhaust port.

40. A vacuum pump comprising:

a pump chamber including an inlet port and a pair of exhaust ports with the inlet port being defined centrally therebetween;

a first rotor and a second rotor, the first and second rotors being mounted adjacent the inlet and one of the exhaust ports;

a lobe mounted to the first rotor adjacent the inlet port and a channel defined in the second rotor adjacent the inlet port, said lobe and said channel cooperating to form a suction section adjacent the inlet port;

a third rotor mounted to an opposite side of the lobe from the first rotor and extending between the lobe and the other of the exhaust ports;

a fourth rotor mounted adjacent the channel opposite to the second rotor, the fourth rotor extending from the channel to the other exhaust port and meshingly engaging with the third rotor.

41. The vacuum pump according to claim 40, further including:

a manifold connecting the exhaust ports with a high pressure exhaust port.

42. A method for reducing power to move a volume of gas through a vacuum pump, the method comprising:

defining a first shaft section disposed in a pump chamber and having a first helical thread extending from adjacent an inlet port to adjacent an exhaust port;

defining a second shaft section disposed in the pump chamber and having a second helical thread extending from adjacent the inlet port to adjacent the exhaust port, the first and second threads intermeshing to define a screw section;

providing a lobe on said first shaft section in the pump chamber abutting an inlet port end of the first helical thread;

defining a channel on said second shaft section at an inlet port end of the second helical thread which channel matingly engages said lobe to form a suction section between the rotors and the inlet port;

rotating the shaft sections, as the shaft sections rotate:

receiving suction gas through the inlet port into the suction section;

closing the inlet port with the lobe trapping the suction gas in the suction section;

with the suction section, directly compressing the suction gas into the screw section;

with the screw section, transporting the compressed suction gas to the exit port.

43. The method according to claim 42 further including: forming said lobe and said channel in the form of V-shaped sections.

44. The method according to claim 42 further including: forming said lobe and said channel in the form of radius-shaped sections.

45. A vacuum pump comprising:

a pump chamber;

an inlet port at an inlet side of the pump chamber and an exhaust port at an outlet side of the pump chamber;

at least two screw rotors mounted in parallel in the pump chamber, each of said screw rotors having at least one helical thread, said helical threads meshing with each other to form closed cells of a screw pump section, said cells moving in a direction to the outlet side during opposite rotation of the rotors;

each of said screw rotors being mounted on a shaft, each of said shafts having an extension at the outlet side end extending in a bearing assembly and a shaft portion at its inlet side end;

at least one male portion and at least one female portion on the shaft inlet sides contiguous to the screw rotors in the pump chamber, the female portion having a complimentary negative profile to the male portion, the male and female portions interengaging each other to form at least one inlet suction section, the screw pump section and the at least one inlet suction section both being disposed in the pump chamber in direct communication with each other;

such that as the shaft rotates, said at least one male portion opens and closes the at least one inlet suction section to the inlet port; and such that during to rotation and after closing the inlet port a suction gas trapped in the at least one inlet suction section is directly compressed into the screw pump section and transported to the exhaust port.

46. The pump according to claim 45, wherein the male portion of the at least one suction section and the rotors of the screw pump section have equal outer diameters.

47. The pump according to claim 45, wherein at least one male portion includes two lobes mounted on each shaft and wherein the rotors of the screw pump section each have two helical teeth.

48. The pump according to claim 45, wherein the number of male portions of said inlet suction section is equal to a number of teeth of the rotors of the screw pump section.

49. A method of evacuation using a vacuum pump which includes a first shaft section disposed in a pump chamber and having a first helical tooth and helical cell extending from adjacent an inlet port to adjacent an exhaust port, a second shaft section disposed in the pump chamber and having a second helical tooth and helical cell extending from adjacent the inlet port to adjacent the exhaust port, the helical teeth and helical cells intermeshing, a male lobe on the first shaft section in the pump chamber abutting an inlet port end of the first helical tooth and groove, a female channel defined on the second shaft section in the pump chamber abutting an inlet end of the second helical tooth and cell, the female channel matingly engaging the male lobe, the method comprising:

rotating the shaft sections;

receiving a suction gas through the inlet port into an inlet suction section defined by the female lobe;

with continuing rotation of the shaft sections, closing the inlet port with the male lobe trapping the suction gas in the suction section;

with continuing rotation, rotating the male lobe and female channel into mating engagement to compress the suction gas into one of the helical cells;

with continued rotation, transporting the compressed gas to the exit by intermeshing action of the intermeshing helical teeth and and cells.

* * * * *